US012152851B2

(12) United States Patent
Plunkett, Jr. et al.

(10) Patent No.: US 12,152,851 B2
(45) Date of Patent: Nov. 26, 2024

(54) FIREARM SUPPRESSOR WITH DIVERTED GAS FLOW

(71) Applicant: WHG Properties, LLC, North Wales, PA (US)

(72) Inventors: Joseph Plunkett, Jr., Clifton Heights, PA (US); William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 62 days.

(21) Appl. No.: 17/014,490

(22) Filed: Sep. 8, 2020

(65) Prior Publication Data

US 2021/0071979 A1 Mar. 11, 2021

Related U.S. Application Data

(60) Provisional application No. 62/897,539, filed on Sep. 9, 2019.

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS

| | | | | |
|---|---|---|---|---|
| 1,066,898 | A | 7/1913 | Gray | |
| 6,575,074 | B1 * | 6/2003 | Gaddini | F41A 21/30 89/14.4 |
| 7,587,969 | B2 * | 9/2009 | Silvers | F41A 21/30 181/223 |
| 8,807,272 | B2 * | 8/2014 | Bladen | F41A 21/30 89/14.3 |
| 8,967,325 | B1 * | 3/2015 | Cronhelm | F41A 21/30 181/223 |
| 9,052,152 | B2 * | 6/2015 | Moss | F41A 21/30 |
| 9,273,920 | B2 * | 3/2016 | Clarke | F41A 21/28 |
| 9,347,727 | B1 * | 5/2016 | Cler | F41A 21/30 |
| 9,933,224 | B2 * | 4/2018 | Dorne | F41A 21/30 |
| 10,533,819 | B2 * | 1/2020 | Thomas | F41A 21/30 |
| 10,746,491 | B2 * | 8/2020 | Garst | F41A 21/30 |
| 10,753,699 | B2 * | 8/2020 | Klett | F41A 21/30 |
| 10,890,403 | B2 * | 1/2021 | Petersen | F42B 39/20 |
| 2014/0216237 | A1 | 8/2014 | Butler | |
| 2017/0299312 | A1 * | 10/2017 | Llewellyn, Jr. | F41A 21/30 |
| 2018/0292160 | A1 | 10/2018 | Petersen | |
| 2018/0313626 | A1 * | 11/2018 | Tomczak | F41A 21/325 |
| 2019/0285375 | A1 * | 9/2019 | Hartwell | F41A 21/30 |
| 2021/0207916 | A1 * | 7/2021 | Belykov | F41A 21/30 |

FOREIGN PATENT DOCUMENTS

| | | | | |
|---|---|---|---|---|
| DE | 102016000429 | A1 * | 7/2017 | F41A 21/30 |

* cited by examiner

*Primary Examiner* — Joshua E Freeman
*Assistant Examiner* — Benjamin S Gomberg
(74) *Attorney, Agent, or Firm* — Alston & Bird LLP

(57) ABSTRACT

The disclosure relates to a firearm suppressor that diverts gas flow away from the firearm user and reduces the report of a fired projectile.

25 Claims, 7 Drawing Sheets

FIREARM SUPPRESSOR WITH DIVERTED GAS FLOW

This application claims the benefit of priority to U.S. Provisional Patent Application No. 62/897,539 filed Sep. 9, 2019, the disclosure of which is hereby incorporated by reference in its entirety.

BACKGROUND

When a cartridge is ignited in a firearm, the cartridge generates an explosion, and propellant gases from the explosion propel a bullet through the barrel of the firearm. This explosion generates a loud report, which may cause damage to the user's hearing. Typically, to reduce the noise intensity of the report, a suppressor may be attached to the muzzle of the barrel.

A conventional suppressor may include a variety of baffles arranged within the suppressor to reduce the report of the explosion. In some suppressors, excess propellant gases from the explosion may be utilized to operate the mechanical action of the firearm and increase the firing cycle of the cartridges. However, if the firearm is fired for an extended period of time, the propellant gases may build up in the chamber of the firearm causing the mechanical action to over-cycle. Moreover, the excess propellant gases, which may be toxic, may vent out the rear of the firearm towards the firearm user.

SUMMARY

The present disclosure relates generally to a firearm suppressor, and more particularly, to a firearm suppressor having a diverted gas flow.

In one aspect, the disclosed technology relates to a firearm suppressor, including: a suppressor body having a muzzle attachment portion; one or more external channels disposed around an outer surface of the suppressor body, the one or more external channels having a hollow center; a plurality of baffles arranged within the suppressor body; an expansion chamber defined by a first baffle of the plurality of baffles and interior walls of the suppressor body; and a gas port positioned at a proximal end of each external channel proximal the muzzle attachment portion, wherein at least one gas port interfaces with the expansion chamber. In one embodiment, the plurality of baffles includes flat baffles, flat angled baffles, conical baffles, or a combination thereof. In another embodiment, the one or more external channels extends in a longitudinal direction of the suppressor body. In another embodiment, a distal end of the one or more external channels is set back from a distal end of the firearm suppressor. In another embodiment, the suppressor is configured to reduce a report of a fired projectile to be within a range of about 120 dB to about 150 dB. In another embodiment, the gas port extends from an interior horizontal wall of the expansion chamber at an angle of about 30 degrees to about 150 degrees. In another embodiment, the firearm suppressor further includes a secondary chamber defined by two adjacent baffles of the plurality of baffles and interior walls of the suppressor body; and a gas port that interfaces with the secondary chamber. In another embodiment, the gas port is configured to interface with a central portion of the expansion chamber. In another embodiment, a diverter is formed on a wall of the expansion chamber, the diverter being positioned within the external channel and configured to direct a gas toward the rear of the suppressor. In another embodiment, the rear of the external channel, which includes the diverter, is configured to direct the gas toward an opening of the external channel. In another embodiment, the proximal end of the one or more external channels is set back from the rear of the suppressor, and a distal end of the one or more external channels is set back from the front of the suppressor. In another aspect, the disclosed technology relates to a firearm including the disclosed firearm suppressor.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE FIGURES

The following drawings are illustrative of particular embodiments of the present disclosure and therefore do not limit the scope of the present disclosure. The drawings are not to scale and are intended for use in conjunction with the explanations in the following detailed description.

DETAILED DESCRIPTION

Figure 1:
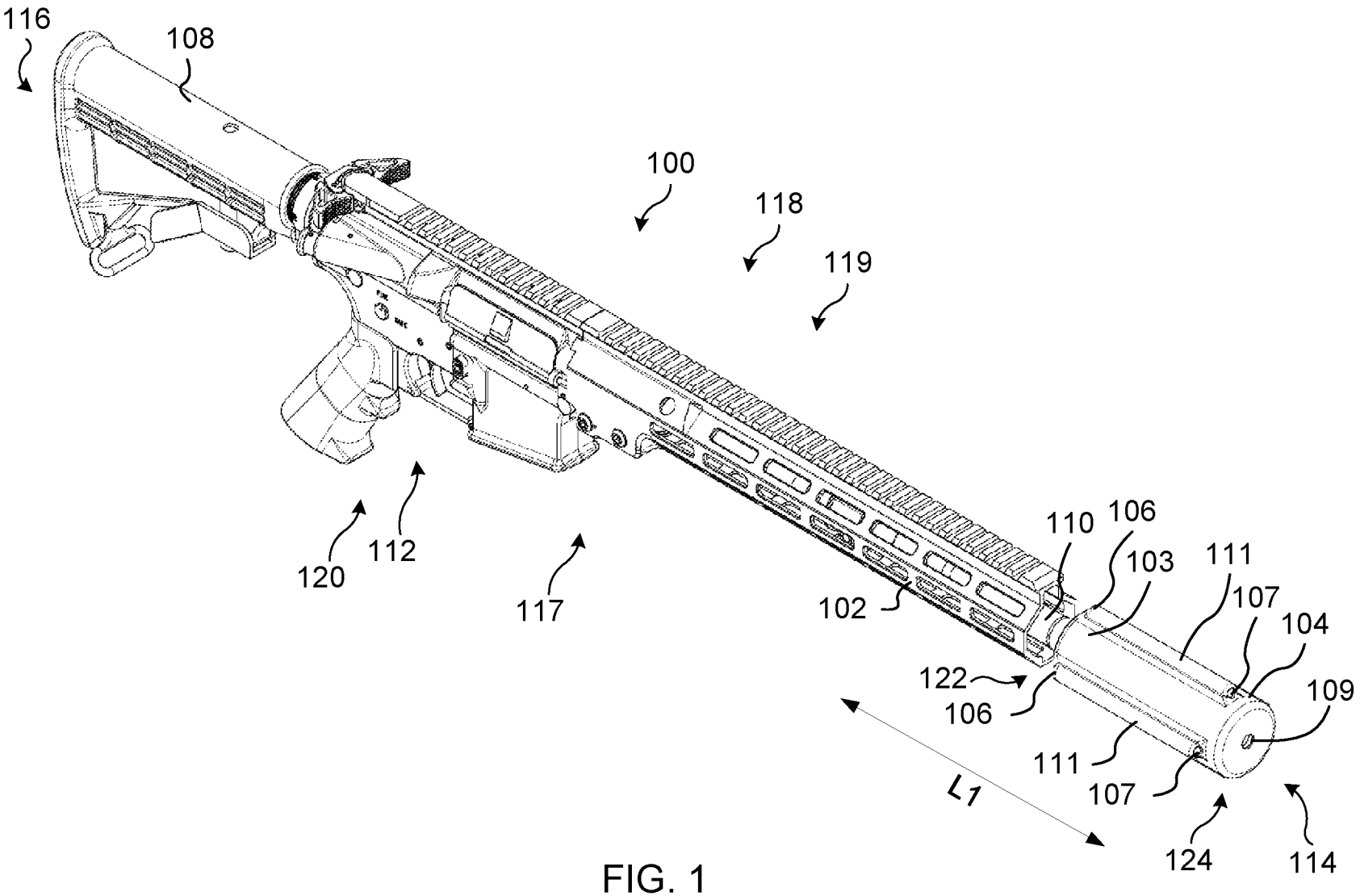
FIG. 1 illustrates a perspective view of an example firearm including an example suppressor.

The following discussion omits or only briefly describes conventional features of firearms and firearm mechanisms that are apparent to those skilled in the art. It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations.

Unless otherwise specifically defined herein, all terms are to be given their broadest reasonable interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof.

Embodiments of the present disclosure relate generally to a firearm suppressor, and more particularly, to a firearm suppressor having a diverted gas flow. Non-limiting embodiments of the firearm suppressor are described below with reference to FIGS. 1-4B.

Figure 2:
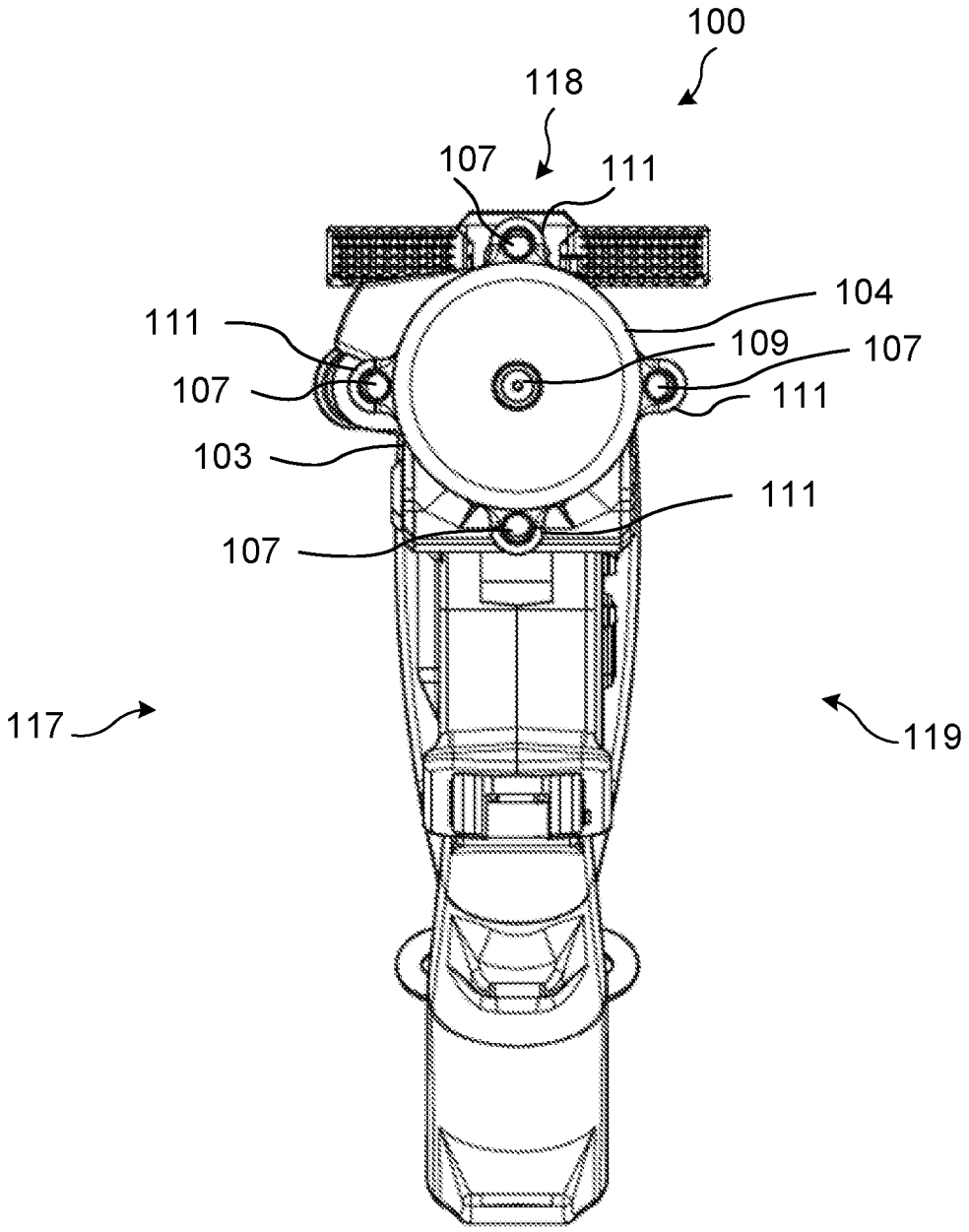
FIG. 2 illustrates a front view of the example firearm including the example suppressor.

FIG. 1 illustrates a perspective view of an example firearm 100 including an example firearm suppressor 103 according to one or more embodiments of the present disclosure. FIG. 2 illustrates a front view of the firearm 100 including the suppressor 103.

In one or more embodiments, the firearm 100 includes at least one of a handguard 102, a stock 108, a barrel 110, and a receiver 112. The firearm 100 is defined by a front 114, a back 116, a right side 117, a top 118, a left side 119, and a bottom 120. Throughout this disclosure, references to orientation (e.g., front, frontward, rear, rearward, in front, behind, above, below, high, low, back, top, bottom, under, underside, right side, left side, etc.) of structural components shall be defined by that component's positioning in FIG. 1 relative to, as applicable, the front 114, the back 116, the right side 117, the top 118, the left side 119, and the bottom 120 of the firearm 100, regardless of how the firearm 100 may be held and regardless of how that component (e.g., the suppressor 103) may be situated on its own (i.e., separated from the firearm 100). The barrel 110 is positioned at a forward end of the firearm 100 and is configured to be installed on the receiver 112. The handguard 102 surrounds the barrel 110 and is attached to the receiver 112. It is noted that the firearm 100 is illustrated as a rifle, but it is understood that one or more of the embodiments discussed herein with respect to the suppressor 103 are applicable to handguns or other types of firearms.

In one or more embodiments, the suppressor 103 may be removably coupled to a muzzle end of the barrel 110. For example, as shown in FIGS. 3B, 3C, 3D, and 4B, the muzzle end of the barrel 110 may include a suppressor attachment portion (e.g., a threaded portion) configured to couple to a muzzle attachment portion (e.g., a threaded portion) of a suppressor body 104. For example, the suppressor 103 may be coupled to the barrel 110 by threading the threaded portion of the muzzle end of the barrel 110 to the threaded portion of the suppressor body 104. The suppressor 103 may be removed from the barrel 110 by unthreading the threaded portion of the muzzle end of the barrel 110 from the threaded portion of the suppressor body 104. In an alternative embodiment, a portion of the suppressor body 104 may be permanently attached to the muzzle end of the barrel 110.

The suppressor 103 includes a central passage 105 and one or more external channels 111 disposed around an outer surface of the suppressor body 104. In one or more embodiments, the suppressor 103 includes one external channel 111 disposed on the outer surface of the suppressor body 104. In one or more embodiments, the suppressor 103 includes a plurality of external channels 111, such as, but not limited to, two, three, four, five, six, seven, eight, nine, ten or more external channels. If the suppressor 103 includes a plurality of external channels 111, the external channels 111 may be evenly spaced in a variety of configurations around the outer surface of the suppressor body 104. In some embodiments, the external channels 111 are spaced apart and not in contact with each other. For example, four external channels 111 may be positioned respectively at 0 degrees, 90 degrees, 180 degrees, and 270 degrees (i.e., a north, south, east, and west configuration) around the outer surface of the suppressor body 104 when viewed from a front view of the suppressor 103 as shown in FIG. 2. In another example, four external channels 111 may be positioned respectively at 45 degrees, 135 degrees, 225 degrees, and 315 degrees (i.e., a northeast, northwest, southeast, and southwest configuration) around the outer surface of the suppressor body 104 when viewed from a front view of the suppressor 103. In one or more other embodiments, the external channels 111 may be irregularly spaced around the outer surface of the suppressor body 104. For example, four external channels 111 may be positioned respectively at 60 degrees, 120 degrees, 240 degrees, and 300 degrees around the outer surface of the suppressor body 104 when viewed from a front view of the suppressor 103 as shown in FIG. 2. In other embodiments, two or more external channels 111 may be grouped together around the outer surface of the suppressor body 104.

The one or more external channels 111 may be configured to divert gas from an interior portion of the suppressor body 104 to a forward end and outside of the suppressor body 104. Each of the one or more external channels 111 may be connected to the interior portion of the suppressor body 104 via one or more gas ports 106. The gas port 106 may divert gas from within the interior portion of the suppressor body 104 to a respective external channel 111. The suppressor 103 may be configured to reduce the sound of the report from a fired projectile to be within a range of about 120 dB to about 150 dB, such as about 130 dB to about 140 dB. One or more of the external channels 111 may be configured to direct the expelled propellant gas away from a user of the firearm 100. Moreover, the suppressor 103 may act as a flash hider configured to reduce the visible signature, e.g., a flash, of the explosion caused by the fired projectile. To reduce the flash of the fired projectile, the suppressor 103 is configured to cool and disperse the propellant gases via the one or more external channels 111 and an interior baffle stack.

An external channel 111 may be a rigid hollow member that extends in a longitudinal direction L1 of the suppressor body 104, such that the external channel 111 generally extends from the back 116 or adjacent the back 116 of the suppressor body 104 to the front 114 or adjacent the front 114 of the suppressor body 104. External channel 111 may have any one of a variety of shapes, including but not limited to tubular, a rectangular, prism, triangular, semi-circular, or the like. Propellant gases may exit the suppressor body 104 via opening 107 of external channel 111. An external channel 111 may have a length of about 1 inch to about 10 inches, such as about 3 inches to about 7 inches, or about 5 inches to about 6 inches. The lengths of the external channels 111 may be the same or different from each other. In one or more embodiments, the length of one or more external channels 111 may be shorter than, the same as, or longer than the length of the suppressor body 104, including combinations thereof. In some embodiments, one or more external channels 111 linearly extend in the longitudinal direction L1 of the suppressor body 104. In other embodiments, one or more external channels 111 helically extend in the longitudinal direction L1 of the suppressor body 104 by spiraling around the outer surface of the suppressor body 104. One or more external channels 111 may extend from, adjacent, or from a position behind a first end 122 of the suppressor body 104 toward a second end 124 of the suppressor body 104, such that an opening 107 of the external channel 111 is set back from the exit port 109 of the suppressor body 104. Alternatively, one or more external channels 111 may extend from, adjacent, or from a position behind the first end 122 of the suppressor body 104 to the second end 124 of the suppressor body 104, such that the opening 107 of the external channel 111 is aligned in a vertical direction with the exit port 109 of the suppressor body 104. In another alternative, one or more external channels 111 may extend from, adjacent, or from a position behind the first end 122 of the suppressor body 104 to a point beyond the second end 124 of the suppressor body 104. The end of external channel 111 at or near the first end 122 of the suppressor body 104 may be angled toward the second end 124 of the suppressor body 104 at an angle (a) of about 90 degrees to about 150 degrees, such as about 120 degrees to about 135 degrees. Alternatively, the end of external channel 111 at or near the first end 122 of the suppressor body 104 may be angled away from the second end 124 of the suppressor body 104 at an angle of about 15 degrees to about 89 degrees, such as about 30 degrees to about 60 degrees.

In one or more embodiments, the external channel 111 may be attached to the suppressor body 104 via a joining process. Non-limiting examples of joining processes include welding, brazing, soldering, riveting, and the like. Alternatively, the external channel 111 may be integrally formed with the suppressor body 104—e.g., by an additive manufacturing process, such as three-dimensional (3D) printing. The suppressor body 104 and external channel 111 may be made from a variety of materials, such as, but not limited to, stainless steel, titanium, Inconel, metal alloys, and/or other heat resistant materials.

Figure 3A:
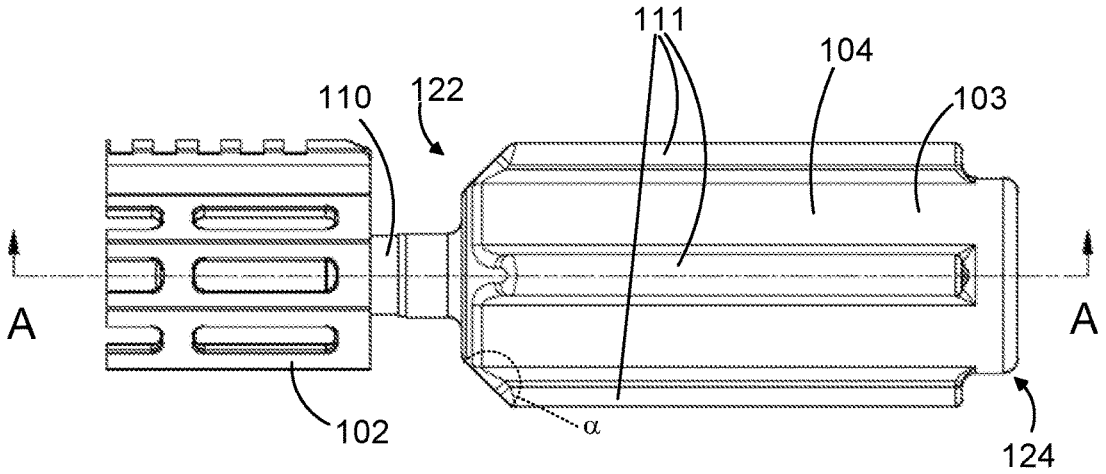
FIG. 3A illustrates a side view of the example suppressor.
Figure 3B:
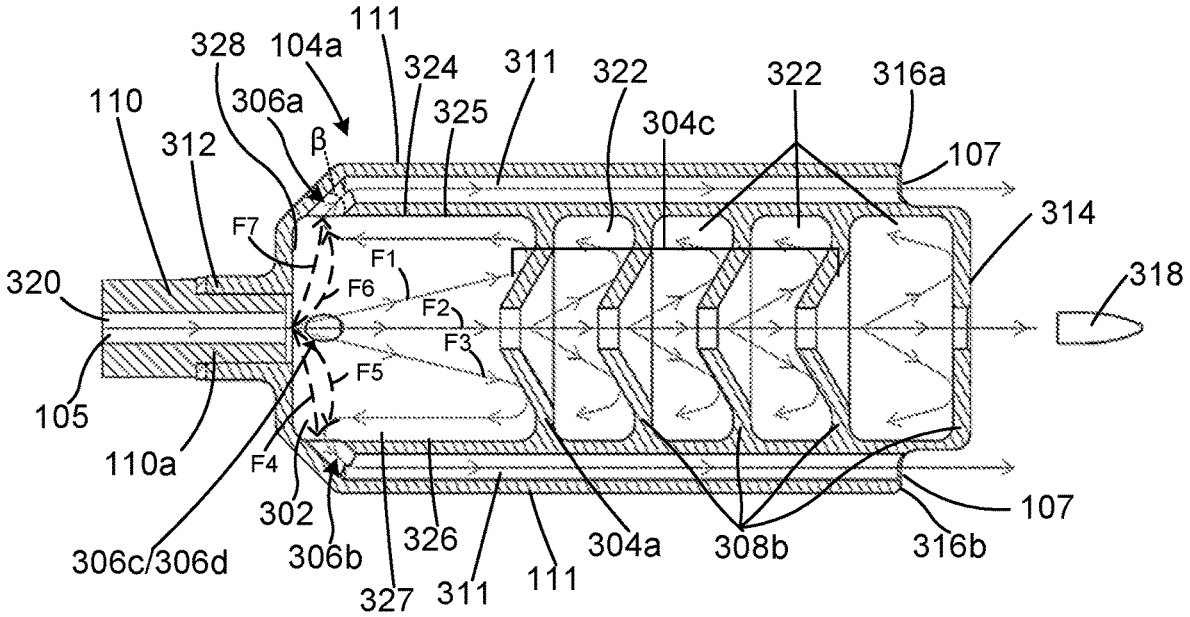
FIG. 3B illustrates a cross-sectional view of an example interior configuration of the example suppressor.
Figure 3C:
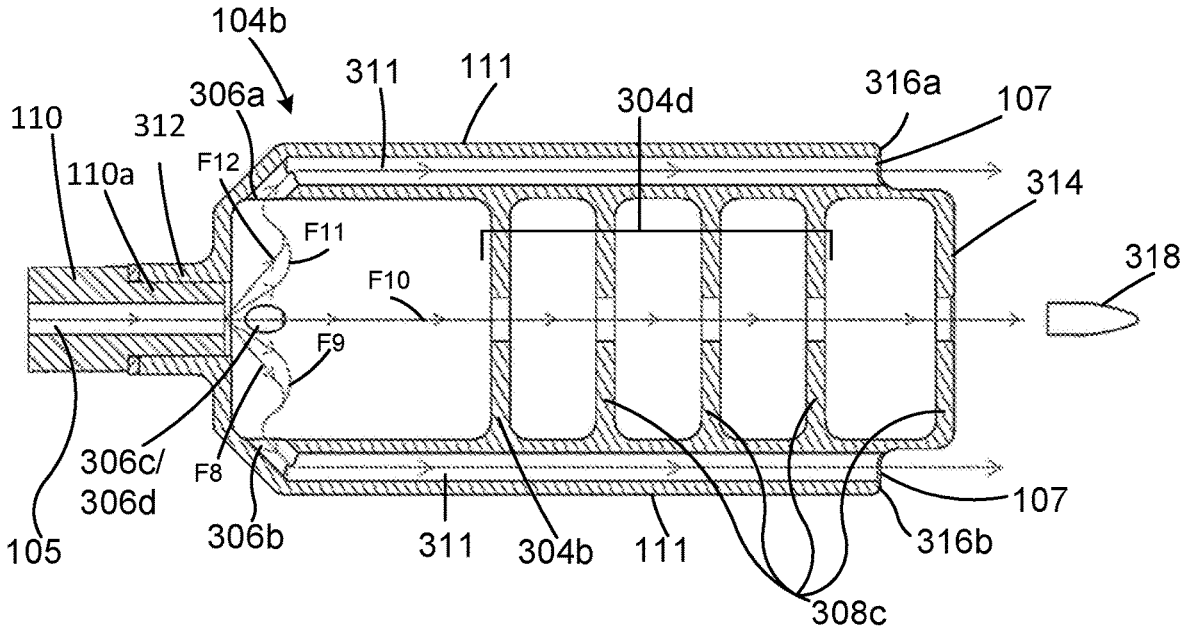
FIG. 3C illustrates a cross-sectional view of another example interior configuration of the example suppressor.

FIG. 3A illustrates a side view of the example suppressor 103. FIG. 3B illustrates a cross-sectional view of an example interior configuration 104*a* of the example suppressor 103. FIG. 3C illustrates a cross-sectional view of another example interior configuration 104*b* of the example suppressor 103. FIG. 3C illustrates a cross-sectional view of an example interior configuration 104*c* of the example suppressor 103.

The suppressor 103 may be removably coupled to the barrel 110 by threading or unthreading an internal or external threaded portion 312 of the suppressor body 104 to a corresponding internal or external threaded portion 110*a* of the muzzle end of the barrel 110. Alternatively, the suppressor 103 may be permanently attached to the muzzle end of the barrel 110. By coupling or attaching the suppressor 103 to the barrel 110, the propellant gas and projectile 318 may pass from the bore 320 of the barrel 110 to the interior of the suppressor 103, such as interior configuration 104*a* shown in FIG. 3A or interior configuration 104*b* shown in FIG. 3B.

In one embodiment, interior configuration 104*a* of the suppressor 103 includes a baffle stack 304*c*. In the present disclosure, the baffle stack 304*c* may be formed as a monolithic core or as a set of individual baffles. The baffle stack 304*c* may be arranged in a configuration to reduce the noise from a report of a projectile 318 fired from the firearm 100. For example, the baffle stack 304*c* may include at least one of a blast baffle 304*a* and one or more secondary baffles 308*b*. The blast baffle 304*a* is positioned nearest the muzzle end of the barrel 110, and may be made from the same or different material than the secondary baffles. The blast baffle 304*a* and secondary baffles 308*b* may have a generally conical shape with central apertures aligned with each other and with the central passage 105 of the suppressor body 104 through which a projectile may pass when the firearm is fired.

An expansion chamber 302 may define a space inside the suppressor body 104 between the outer surface of the blast baffle 304*a* (facing the barrel 110) and the interior walls of the suppressor body 104—i.e., the innermost vertical wall 328 (at proximal end 332 of expansion chamber 302 facing the outer surface of the blast baffle 304*a*) and the horizontal wall 325. In one or more embodiments, the expansion chamber 302 may be cylindrically shaped, in which the horizontal wall 325 forms the curved surface of the cylindrically shaped expansion chamber 302. The horizontal wall 325 may be defined by an upper portion 324, a lower portion 326, and side portions 327, when viewed from a cross-sectional side view as shown in FIG. 3B. The innermost vertical wall 328 may be the wall adjacent to the threaded portion 312 of the suppressor body 104. The innermost vertical wall 328 may form one end of the cylindrically shaped expansion chamber 302, and the outer surface of the blast baffle 304*a* may form the other end of the cylindrically shaped expansion chamber 302. The upper portion 324 of the horizontal wall 325 may form the curved upper surface of the cylindrically shaped horizontal wall 325. The lower portion 326 of the horizontal wall 325 may form the lower curved surface of the cylindrically shaped horizontal wall 325. The side portions 327 of the horizontal wall 325 may form the curved side surfaces of the cylindrically shaped horizontal wall 325. In one or more other embodiments, the expansion chamber 302 may be formed in another shape, such as a rectangular shape in which the horizontal wall 325 includes four walls such as an upper wall, a lower wall, and two side walls, in which the upper wall is connected to the two side walls at right angles, and the lower wall is connected to the two side walls at right angles. The expansion chamber 302 is configured to receive the propellant gas from the barrel 110 before the propellant gas flows to the gas ports 106 and/or the one or more secondary chambers 322. In some embodiments, the gas port 106 extends from the horizontal wall 325 at an angle of about 30 degrees to about 150 degrees, such as about 60 degrees to about 120 degrees, about 75 degrees to about 105 degrees, or about 90 degrees.

The blast baffle 304*a* is configured to shear propellant gas toward one or more of the innermost wall 328, upper portion 324, side portion 327, and lower portion 326, defining a perimeter of the expansion chamber 302, and/or toward one or more gas ports 106. Shearing the propellant gas slows the movement of the gas and cools its temperature, thereby reducing the noise level of the fired projectile 318. A secondary chamber 322 may be defined by the space between the interior surface of the blast baffle 304*a* (proximal the exit port 109), the upper portion 324, the lower portion 326, and the outer surface of the secondary baffle 308*b* adjacent the blast baffle 304*a*. One or more other secondary chambers 322 may be defined by the area between an interior surface of a secondary baffle 308*b*, the upper portion 324, the lower portion 326, and an outer surface of an adjacent secondary baffle 308*b*. In one or more embodiments, expansion chamber 302 may have a larger volume than secondary chamber 322.

In one or more embodiments, each external channel 111 includes a hollow center forming a bore 311. The external channel 111 may have an opening 107 disposed at distal end 316*a*, 316*b* of external channel 111 toward the front 314 of the suppressor 103, and a gas port (e.g., gas port 306*a*) having an opening disposed toward expansion chamber 302 at the first end 122 of the suppressor body 104. The shape of the bore 311 may be consistent with the shape of the external channel 111—e.g., each of the bore 311 and the external channel 111 may have a tubular shape. Alternatively, the shape of the bore 311 may be different from the shape of the external channel 111—e.g., the bore 311 may have a tubular shape, and the external channel 111 may have a rectangular, prism, or other non-tubular shape.

The gas port (e.g., gas port 306*a*) interfaces with the interior of the suppressor body 104, whereby propellant gases enter bore 311 from the interior of the suppressor body 104 via the gas port. In some embodiments, one or more gas ports (e.g., gas ports 306*a*, 306*b*, 306*c*, and 306*d*) interface with expansion chamber 302 of the suppressor body 104. Alternatively, one or more gas ports may interface with expansion chamber 302, and one or more other gas ports may interface with one or more secondary chambers 322 of the suppressor body 104. The gas port may be integrally formed with the bore 311. The gas port 306*a* may be positioned at or near the first end 122 of the suppressor body 104. The gas port 306*a* may have a tubular or cylindrical shape. The diameter of the gas port 306*a* may be the same as or greater than the diameter of the bore 311. For example, the shape of the gas port 306*a* may taper from its distal end toward its proximal end, wherein the proximal end of the gas port 306*a* interfaces with the bore 311. In such examples, the gas port 306*a* may have a conical shape with a narrow end that interfaces with the end of the bore 311 proximal the barrel 110.

As shown in FIGS. 3A-3D, the gas port 306*a* may be angled toward the front 114 of the suppressor 103. For example, gas port 306*a* may extend from upper portion 324 of the expansion chamber 302 toward the end of the bore 311 proximal the barrel 110 at an angle (β) of about 30 degrees to about 90 degrees, such as about 45 degrees to about 60 degrees. Gas ports 306*b*, 306*c*, and 306*d* include one or more of the same or similar features as gas port 306*a*. Accordingly, a description of such features is not repeated.

In one or more embodiments, when propellant gases move into the expansion chamber 302, the gases expand and fill the expansion chamber and may further move along one or more flow paths. For example, some of the propellant gases may expand along flow path F2 through one or more of gas ports, one or more baffles, and out of exit port 109 of the suppressor body 104. In another example, some of the propellant gases may expand along flow paths F4, F5, F6, and/or F7 through gas ports 306*a*, 306*b*, 306*c*, and 306*d* and into their respective bores 311. In yet another example, some of the propellant gas may expand toward the blast baffle 304*a* and shear off the blast baffle 304*a* toward the gas ports 306*a*, 306*b*, 306*c*, and 306*d*. Propellant gases that shear of the blast baffle 304*a* may enter one or more of the bores via their respective gas ports 306*a*, 306*b*, 306*c*, and 306*d*. Propellant gas that enters a bore, such as bore 311, may travel through bore 311 and exit opening 107 of the external channel 111.

As shown in FIG. 3C, interior configuration 104*b* of the suppressor body 104 may include a baffle stack 304*d* having at least one of a blast baffle 304*b* and one or more secondary baffles 308*c*. Baffle stack 304*d* may have one or more of the same or similar features as baffle stack 304*c* described herein. To that extent, a description of the features of the baffle stack 304*d* that have the same or similar features as the baffle stack 304*c* are not repeated. Also, the interior configuration 104*b* includes one or more of the same or similar features of the interior configuration 104*a*, in particular with respect to the gas ports, external channels 111, bores 311, and flow paths, such as flow paths F8, F9, F10, F11, and F12. Accordingly, a description of such features is also not repeated. Baffle stack 304*d* is distinguishable from baffle stack 304*c* in that the least one of a blast baffle 304*b* and one or more secondary baffles 308*c* may be a series of flat baffles, a series of flat angled baffles, a series of conical baffles, or a combination thereof.

Figure 3D:
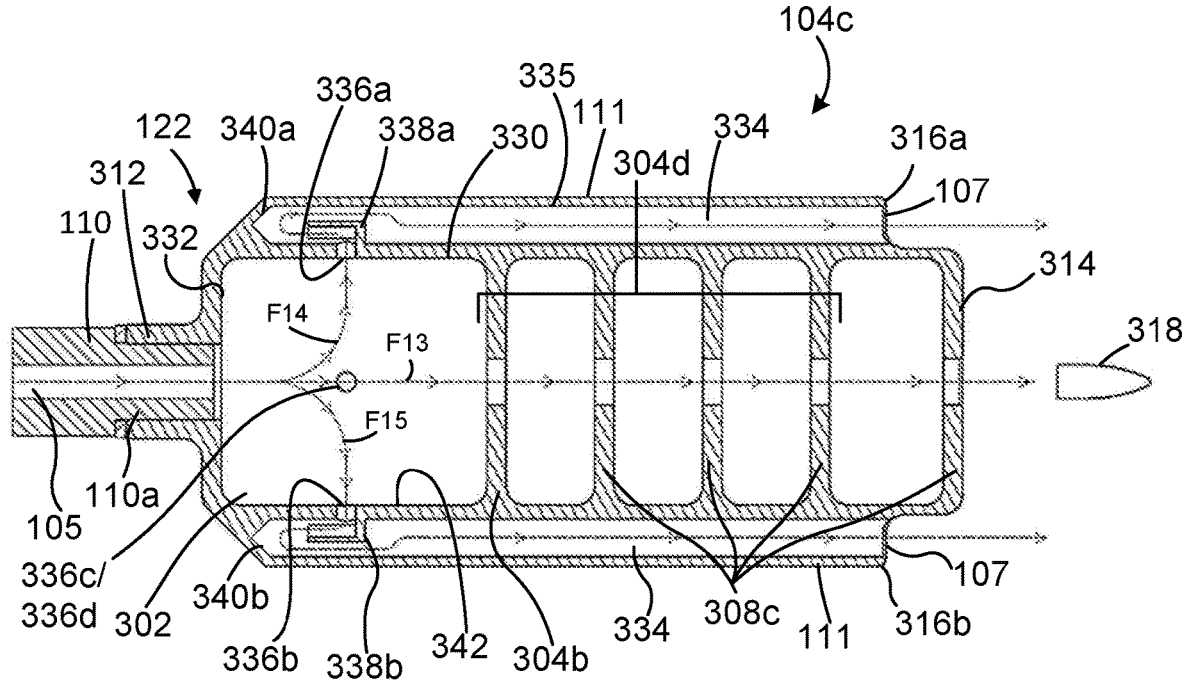
FIG. 3D illustrates a cross-sectional view of another example interior configuration the example suppressor of FIG. 3A.

As shown in FIG. 3D, interior configuration 104*c* of the suppressor body 104 may include a baffle stack 304*d* similar to that of the baffle stack 304*d* in the interior configuration 104*b*. Further, interior configuration 104*c* may include a baffle stack such as baffle stack 304*c* of interior configuration 104*a*. Gas ports 336*a*, 336*b*, 336*c*, and 336*d* of interior configuration 104*c* may be positioned to interface with a central portion of expansion chamber 302. For instance, gas port 336*a* may be positioned in the center of upper wall 330 of expansion chamber 302, and the gas port 336*b* may be positioned in the center of lower wall 342 of expansion chamber 302. Similarly, the gas ports 336*c* and 336*d* may be positioned in the centers of the side portions 327 of expansion chamber 302.

As shown in FIG. 3D, a gas port (e.g., gas port 336*b*) may include a propellant gas diverter 338*a* configured to direct the propellant gas toward the back 116 of the suppressor 103 and then toward the front 114 of the suppressor 103 through bore 334 and out of the opening 107 of external channel 111. For example, the propellant gas may move along flow path F14 from the expansion chamber 302 into the gas port 336*a*. The propellant gas then deflects off the diverter 338*a* toward the back 116 of the suppressor 103. Having contacted the end 340*a* of the bore 334, the propellant gas flows through the bore 334 toward the opening 107 of the external channel 111. In one or more embodiments, the diverter 338*a* may be integrally formed with the upper wall 330 of the expansion chamber 302, such that the diverter 338*a* and the upper wall 330 are a monolithic body. In one or more other embodiments, the diverter 338*a* may be a separate component attached to the upper wall 330 of the expansion chamber, via a joining process, such as, but not limited to, welding, brazing, soldering, riveting, or the like. The diverter 338*a* may be formed from the same or different material as the upper wall 330. In one or more embodiments, the diverter 338*a* may extend from the upper wall 330 of the expansion chamber 302 toward the back 116 of the suppressor 103 at an angle of about 60 degrees to about 120 degrees, such as about 80 degrees to about 100 degrees, or about 90 degrees. In some embodiments, the diverter 338*a* is formed in an "L" type shape, as depicted in FIG. 3D. It is noted that gas ports 336*b*, 336*c*, and 336*d* include one or more of the same or similar features as gas port 336*a*, and one or more of gas ports 336*b*, 336*c*, and 336*d* may include a diverter similar to that of diverter 338*a*. Accordingly, a description of such features is not repeated.

In one or more other embodiments, the external channel 111 may include two or more diverters to direct the propellant gas flow within the bore 334—e.g., along a generally sinusoidal flow path. For example, a first diverter may have a "T" type shape, in which one vertical portion of the diverter extends from the upper wall 330 of the expansion chamber 302; one horizontal portion of the diverter, attached to an end of the vertical portion opposite the end attached to the upper wall 330, extends towards the back 116 of the external channel 111; and one horizontal portion of the diverter, attached to the end of the vertical portion opposite the end attached to the upper wall 330, extends towards the front 114 of the external channel 111. The horizontal portion of the first diverter extending towards the front 114 may extend a greater distance greater from the end of the vertical portion than the horizontal portion of the first diverter extending towards the back 116 of the external channel 111. The first diverter may direct the propellant gas flow from the expansion chamber 302 to the back 116 of the external channel 111, via the vertical portion and the horizontal portion of the first diverter facing the back 116 of the external channel 111. The propellant gas flow may flow towards the front 114 of the external channel 111 by contacting the back 116 of the external channel and/or wrapping around the horizontal portion of the first diverter facing the back 116 of the external channel 111. The propellant gas flow may flow towards the front 114 of the external channel 111 following a path defined by the upper wall 335 of the external channel 111 and the horizontal portion of the first diverter extending towards the front 114.

A second diverter may be formed with the upper wall 335 of the external channel 111. The second diverter may be positioned downstream from the first diverter within the bore 334. The second diverter may positioned at or near the end of the horizontal portion of the first diverter extending towards the front 114 of the external channel 111. A vertical portion of the second diverter extends downwards from the upper wall 335 into the central portion of the bore 334, and a horizontal portion of the second diverter extends towards the back 116 of the external channel 111, thereby forming an inverted "L" type, similar to the "L" type shape of the diverter 338*a*. The portion of the second diverter extending towards the back 116 of the external channel 111 may be positioned such that the portion of the second diverter extending towards the back 116 of the external channel 111 is below the horizontal portion of the first diverter extending towards the front 114. As the propellant gas flow travels towards the front 114 of the external channel 111, the propellant gas flow contacts the second diverter and is redirected towards the back 116 of the external channel 111. The propellant gas flow may flow towards the front 114 of the external channel 111 by contacting the vertical portion of the first diverter and/or wrapping around the horizontal portion of the second diverter facing the back 116 of the external channel 111.

Figure 4A:
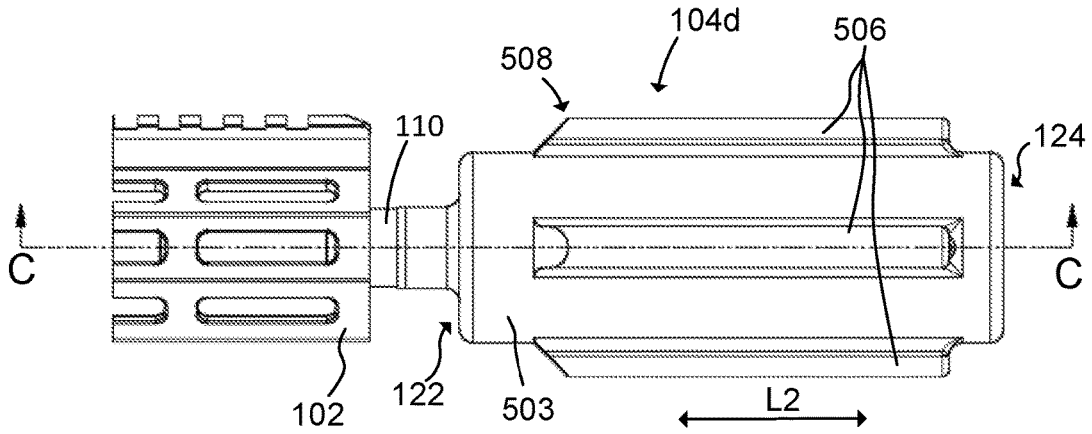
FIG. 4A illustrates a side view of another example suppressor positioned on the front of the example firearm of FIG. 1.
Figure 4B:
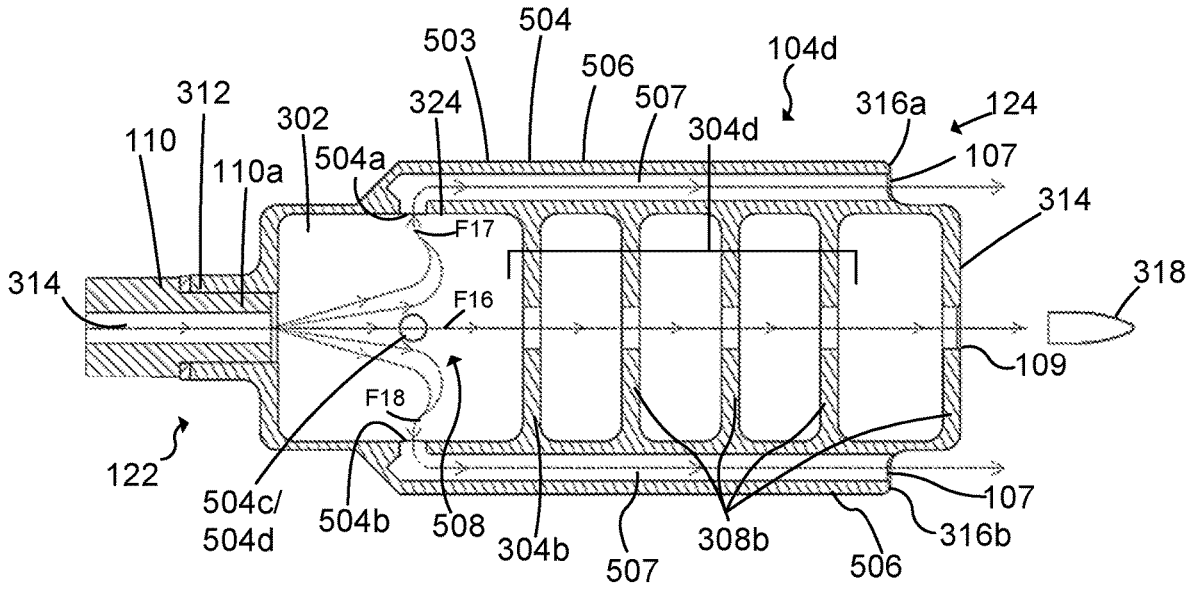
FIG. 4B illustrates a cross-sectional view of an interior configuration of the example suppressor of FIG. 4A.

FIG. 4A illustrates a side view of another example suppressor 503 positioned on the front 114 of the example firearm 100 of FIG. 1. FIG. 4B illustrates a cross-sectional view of an interior configuration 104*d* the example suppressor 503 of FIG. 4A.

In one or more embodiments, the suppressor 503 includes one or more external channels 506 disposed around an outer surface of the suppressor body 504. The one or more external channels 506 may be configured to divert gas from an interior portion of the suppressor body 504 to a forward end and outside of the suppressor body 504. Each of the one or more external channels 506 may be connected to the interior portion of the suppressor body 504 via one or more gas ports, such as gas ports 504*a*, 504*b*, 504*c*, and 504*d*, respectively. The gas port (e.g., gas port 506*a*) may divert gas from within the interior portion of the suppressor body 504 to a respective external channel 506. The suppressor body 504 includes one or more of the same or similar features as the suppressor body 104, which may be indicated by like reference numbers in FIGS. 4A and 4B. Accordingly, a description of such features is not repeated. Similar to the suppressor 103, the suppressor 503 may be configured to reduce the sound of a report from a fired projectile to be within a range of about 120 dB to about 150 dB, such as about 130 dB to about 140 dB. One or more of the external channels 506 may be configured to direct the expelled propellant gas away from a user of the firearm 100. Moreover, the suppressor 503 may act as a flash hider configured to reduce the visible signature, e.g., a flash, of the explosion caused by the fired projectile. To reduce the flash of the fired projectile, the suppressor 503 is configured to cool and disperse the propellant gases via one or more external channels 506 and an interior baffle stack.

An external channel 506 may be a rigid hollow member that extends in a longitudinal direction L2 of the suppressor body 504, such that the external channel 506 generally extends from the back 116 or adjacent the back 116 of the suppressor body 504 to the front 114 or adjacent the front 114 of the suppressor body 504. An external channel 506 may have a length of about 1 inch to about 10 inches, such as about 3 inches to about 7 inches, or about 5 inches to about 6 inches. The lengths of the external channels may be the same or different from each other. In one or more embodiments, one or more external channel 506 linearly extends in the longitudinal direction L2 of the suppressor body 504. In other embodiments, one or more external channel 506 helically extends in the longitudinal direction L2 of the suppressor body 504 by spiraling around the outer surface of the suppressor body 504.

In some embodiments, the end of external channel 506 at or near the first end 122 of the suppressor body 504 may be angled toward the second end 124 of the suppressor body 504 at an angle of about 90 degrees to about 150 degrees, such as about 120 degrees to about 135 degrees.

In one or more embodiments, the external channel 506 may extend from an area over a central portion 508 of an expansion chamber 302 of the interior configuration 104*d* to a second end 124 of the suppressor body 504. An opening 107 of the external channel 506 may be set back from the exit port 109 of the suppressor body 504. An end of the external channel 506 on the first end 122 may be positioned over the central portion of the expansion chamber 302, such that the end of the external channel 506 is set back from the first end 122 of the suppressor body 504. In one or more other embodiments, the external channel 506 may extend from the central portion 508 to the second end 124 of the suppressor body 504, such that the opening 107 of the external channel 506 is aligned, in a vertical direction, with the exit port 109 of the suppressor body 504. Propellant gases may exit the suppressor body 504, via opening 107 of the external channel 506.

In one or more embodiments, the external channel 506 may have a tubular shape, a rectangular prism shape, a triangular prism shape, or the like. For the embodiments in which suppressor 503 includes multiple external channels 506, the external channels 506 may be disposed around the outer surface of the suppressor body 504 in a variety of configurations, and optionally evenly spaced. For example, for the embodiments in which four external channels 506 are disposed around the outer surface of the suppressor body 504, the four external channels 506 may extend in a longitudinal direction L2 of the suppressor body 504 and be arranged in a north, south, east, and west configuration when viewed from a front view of the suppressor 503, or in a northeast, northwest, southeast, and southwest configuration when viewed from a front view of the suppressor 503.

In one or more embodiments, the interior configuration 104*d* of the suppressor body 504, shown in FIGS. 4A and 4B, may include a baffle stack 304*d* similar to that of the baffle stack 304*d* in the interior configuration 104*b*. In one or more other embodiments, the interior configuration 104*d* of the suppressor body 504 may include a baffle stack such as the baffle stack 304*c* of the interior configuration 104*a*.

The gas port, such as gas port 504*a*, may be integrally formed with the bore 507 of the external channel 506. The gas port 504*a* may be positioned at the proximal end of the bore 507 of the external channel 506 and over the area of the central portion 508 of the expansion chamber 302. In one or more embodiments, the gas port 504*a* may have a tubular or cylindrical shape. The diameter of the gas port 504*a* may be the same as or greater than the diameter of the bore 507. For example, the shape of the gas port 504*a* may taper from its distal end toward its proximal end, wherein the proximal end interfaces with the proximal end of the bore 507. In such examples, the gas port 504*a* may have a conical shape with a narrow end that interfaces with the end of the bore 507 proximal the barrel 110.

In one or more embodiments, the gas port may be angled toward the front 114 of the suppressor 503. For example, the gas port 306*a* may extend from the upper portion 324 of the expansion chamber 302 at about a 90° angle towards the proximal end of the bore 311. In another example, the gas port 504*a* may extend from the upper portion 324 of the expansion chamber 302 toward the end of the bore 507 proximal the barrel 110 at an angle of about 30 degrees to about 90 degrees, such as about 45 degrees to about 60 degrees. It is noted that the gas ports 504*b*, 504*c*, and 504*d* include one or more of the same or similar features as gas port 504*a*. Accordingly, a description of such features is not repeated.

In one or more embodiments, when propellant gases move into the expansion chamber 302, the gases expand and fill the expansion chamber. For example, some of the propellant gases may expand along a flow path F16 toward the one or more secondary baffles 308*b* and out of the exit port 109 of the suppressor 503. In another example, some of the propellant gases may expand along flow paths F16, F17, and/or F18 to the gas ports 504*a*, 504*b*, 504*c*, and 504*d* and enter their respective bores 507. In another example, some of the propellant gas may flow toward the blast baffle 304*b* and shear off the blast baffle 304*b* toward gas ports 504*a*, 504*b*, 504*c*, and 504*d*. Propellant gases that shear the blast baffle 304*b* may enter one or more bores 507 via their respective gas ports 504*a*, 504*b*, 504*c*, and 504*d*. Propellant gas that enters a bore 507 may travel through the bore 507 and exit the opening 107 of the external channel 506.

Figure 5A:
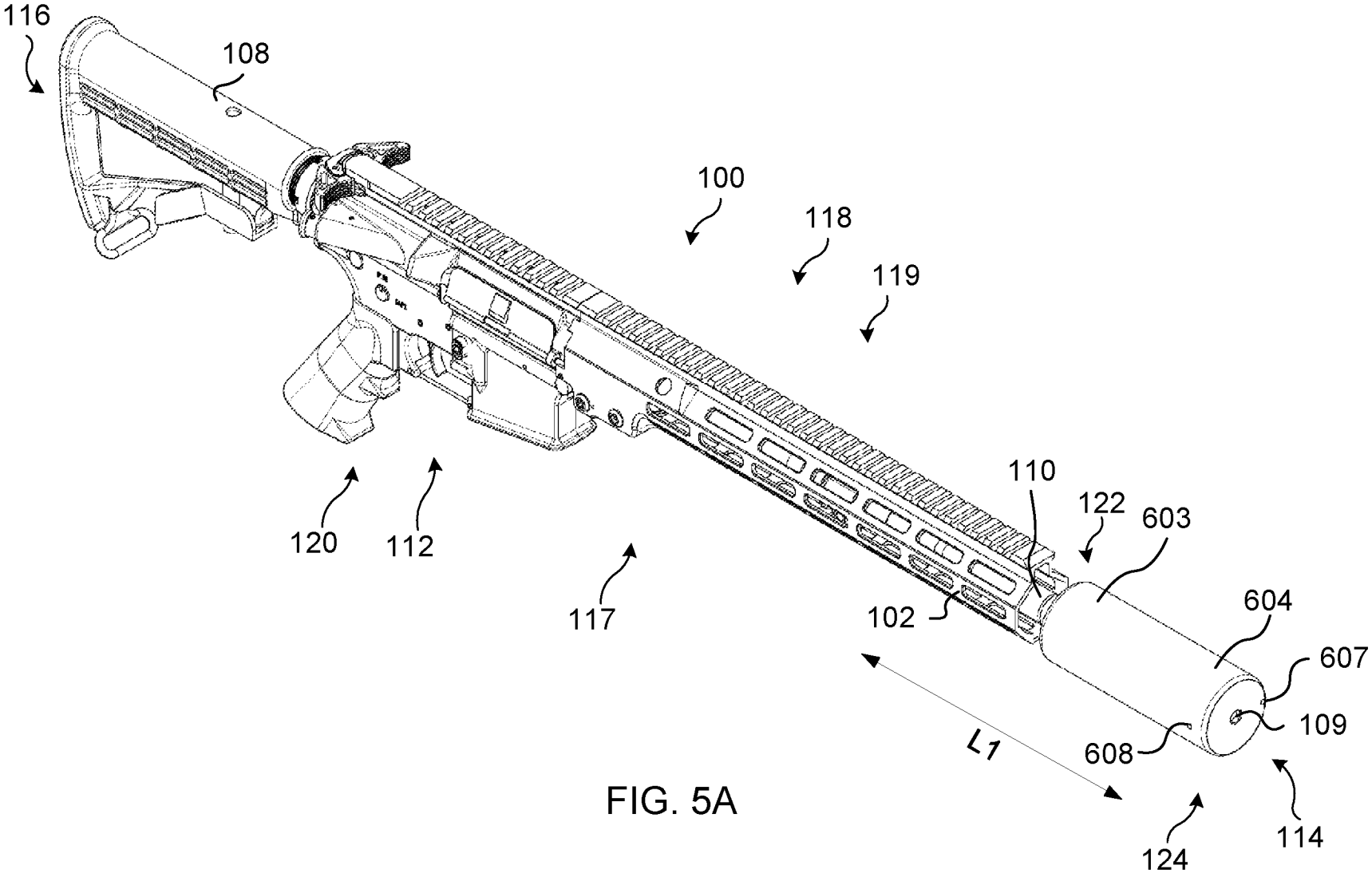
FIG. 5A illustrates a perspective view of an example firearm including an example suppressor.
Figure 5B:
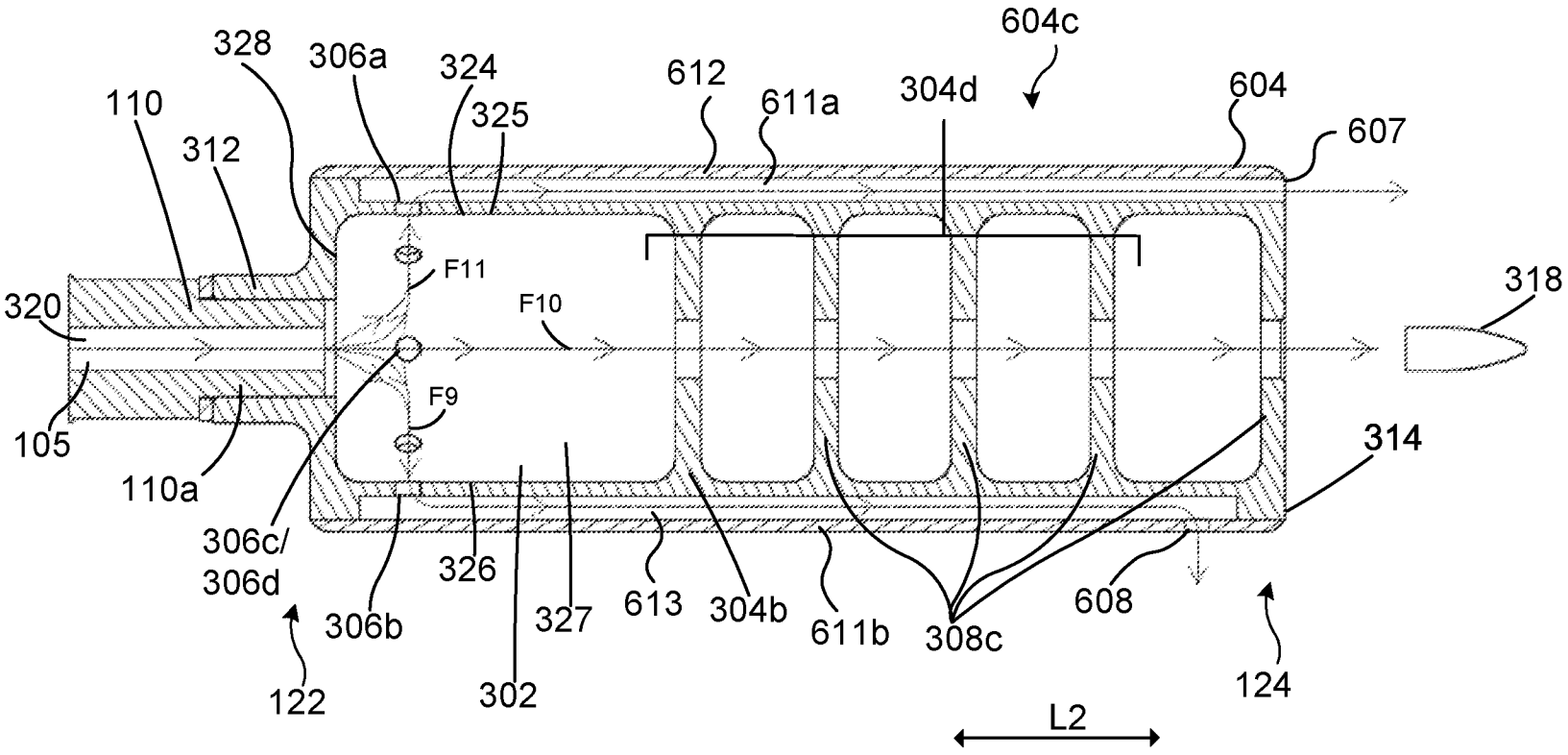
FIG. 5B illustrates a cross-sectional view of an example interior configuration of an example suppressor.

FIG. 5A illustrates a perspective view of the example firearm 100 including an example suppressor 603. FIG. 5B illustrates a cross-sectional view of an example interior configuration 604*c* of the example suppressor 603. The firearm 100 and suppressor 603, illustrated in FIGS. 5A and 5B, include one or more of the same or similar features of the firearm 100, suppressor 103, and suppressor 503, illustrated in FIGS. 1, 2, 3A, 3B, 4A, and 4B. The same or similar features are indicated using like reference numbers. Accordingly, a description of such features is not repeated. Moreover, the interior configuration 604*c* of the suppressor body 604 may include a baffle stack similar to baffle stack 304*d* of interior configuration 104*b* or baffle stack 304*c* of interior configuration 104*a*.

In one or more embodiments, the suppressor 603 includes one or more internal channels 611, such as internal channel 611*a* and internal channel 611*b*, disposed within the suppressor body 604. The suppressor body 604 may form the outer surface of the suppressor 603. The one or more internal channels 611 may be configured to divert gas from an interior portion of the suppressor body 604 to a forward end and outside of the suppressor body 604. Each of the one or more internal channels 611 may be connected to the interior portion, such as the expansion chamber 302, of the suppressor body 604 via one or more gas ports, such as gas ports 306*a*, 306*b*, 306*c*, and 306*d*, respectively. The gas port (e.g., gas port 306*a*) may divert gas from within the interior portion of the suppressor body 504 to a respective internal channel 611. In one or more embodiments, the gas ports may be connected to their own respective internal channel 611. In one or more other embodiments, the suppressor body 604 includes a cylindrical channel around an interior portion, such as the expansion chamber 302, of the suppressor body 604, which connects each gas port to a chamber, such as the expansion chamber 302 or secondary chambers of the baffle stack 304*d*, and at least one internal channel 611.

Similar to suppressor 103 and suppressor 503, the suppressor 603 may be configured to reduce the sound of a report from a fired projectile to be within a range of about 120 dB to about 150 dB, such as about 130 dB to about 140 dB. One or more of the internal channels 611 may be configured to direct the expelled propellant gas away from a user of the firearm 100. Moreover, the suppressor 603 may act as a flash hider configured to reduce the visible signature, e.g., a flash, of the explosion caused by the fired projectile. To reduce the flash of the fired projectile, the suppressor 603 is configured to cool and disperse the propellant gases via one or more internal channels 611 and an interior baffle stack.

The internal channel 611 may be a rigid hollow member that extends in a longitudinal direction L2 of the suppressor body 604, such that the internal channel 611 generally extends from the back 116 or adjacent the back 116 of the suppressor body 604 to the front 114 or adjacent the front 114 of the suppressor body 604. The internal channel 611 includes a bore, such as bore 612, that includes one or more of the same or similar features as bore 311.

In one or more embodiments, at least one internal channel, such as internal channel 611*a*, may extend in a longitudinal direction L2 from a gas port, such as gas port 306*a*, to a forward facing opening 607 on the front 114 of the suppressor body 604. Propellant gas may travel from the gas port 306*a* through the bore 612 of the internal channel 611*a* and out of the forward facing opening 607, such that the propellant gas exits the front 114 of the suppressor 603. In one or more embodiments, at least one internal channel, such as internal channel 611*b*, may extend in a longitudinal direction L2 from a gas port, such as gas port 306*b*, to a side facing opening 608 on a side of the suppressor body 604, such as a right side 117, a top 118, a left side 119, and a bottom 120 of the suppressor body 604. Propellant gas may travel from the gas port 306*b* through the bore 613 of the internal channel 611*b* and out of the side facing opening 608, such that the propellant gas exits a side of the suppressor 603. In one or more other embodiments, at least one internal channel, may extend in a longitudinal direction L2 from a gas port to a side facing opening on a side of the suppressor body 604 and a forward facing opening on the front 114 of the suppressor body 604. That is, an end of an internal channel, disposed on an end opposite a gas port, may include both a forward facing opening, similar to the forward facing opening 607, and a side facing opening, similar to the side facing opening 608.

It is noted that one or more external channels 111 and/or one or more external channels 506 may include a forward facing opening and/or a side facing opening, similar to that of the forward facing opening 607 and the side facing opening 608 as described above.

As used herein, the term "about" in reference to a numerical value means the numerical value itself plus or minus 10% of the numerical value of the number with which it is being used.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A firearm suppressor, comprising:

a suppressor body having a muzzle attachment portion and an interior horizontal wall;

two or more external channels disposed around an outer surface of the suppressor body, each of the two or more external channels having a hollow center, a proximal end, and a distal end;

a plurality of baffles arranged within the suppressor body; and a primary expansion chamber defined at least in part by a first baffle of the plurality of baffles and a first portion of the interior horizontal wall of the suppressor body, wherein:

each said proximal end of the two or more external channels comprises a gas port that interfaces with the primary expansion chamber;

each said distal end of the two or more external channels comprises an opening configured to permit gas to exit the suppressor body during use;

at least a portion of the two or more external channels is defined in part by the first portion of the interior horizontal wall of the suppressor body;

at least a section of the first portion of the interior horizontal wall is located between the gas port and the first baffle;

an outer periphery of the primary expansion chamber is spaced maximally from a longitudinal centerline of the suppressor body by a first distance;

the two or more external channels are spaced minimally from the longitudinal centerline of the suppressor body by a second distance greater than the first distance; and each of the two or more external channels is unobstructed.

2. The firearm suppressor of claim 1, wherein the plurality of baffles comprises flat baffles, flat angled baffles, conical baffles, or a combination thereof.

3. The firearm suppressor of claim 1, wherein each of the two or more external channels extend in a longitudinal direction of the suppressor body.

4. The firearm suppressor of claim 1, wherein each said opening of the two or more external channels is set back from a distal end of the firearm suppressor.

5. The firearm suppressor of claim 1, wherein the firearm suppressor is configured to reduce a report of a fired projectile to be within a range of about 120 dB to about 150 dB.

6. The firearm suppressor of claim 1, wherein each said gas port extends from the interior horizontal wall of the primary expansion chamber at an angle of about 30 degrees to about 150 degrees.

7. The firearm suppressor of claim 1, further comprising a secondary expansion chamber defined by a second baffle of the plurality of baffles adjacent the first baffle, a third baffle of the plurality of baffles adjacent the second baffle, and a second portion of the interior horizontal wall of the suppressor body, wherein the second baffle comprises a gas port that interfaces with the secondary expansion chamber.

8. The firearm suppressor of claim 7, wherein the gas port of the second baffle is configured to interface with a central portion of the primary expansion chamber.

9. The firearm suppressor of claim 1, wherein each said proximal end of the two or more external channels is set back from a rear of the firearm suppressor.

10. The firearm suppressor of claim 1, wherein a proximal end of the primary expansion chamber is directly adjacent the muzzle attachment portion.

11. The firearm suppressor of claim 1, wherein each said gas port at each said proximal end of the two or more external channels directly interfaces with the primary expansion chamber.

12. The firearm suppressor of claim 1, wherein:

the first and a second of the plurality of baffles define a secondary chamber; and the secondary chamber is bounded by the interior horizontal wall.

13. The firearm suppressor of claim 1, wherein the two or more external channels are spaced symmetrically about an outer circumference of the firearm suppressor.

14. The firearm suppressor of claim 1, wherein one of the two or more external channels is disposed above a midline of the firearm suppressor.

15. The firearm suppressor of claim 14, wherein the one of the two or more external channels is disposed on a top of the firearm suppressor.

16. The firearm suppressor of claim 1, wherein each of the two or more external channels is linear.

17. The firearm suppressor of claim 1, wherein:

the suppressor body defines an exit port; and the exit port and the openings in the distal end of the two or more external channels face the same direction.

18. The firearm suppressor of claim 1, wherein the two or more external channels are located entirely radially outward of the primary expansion chamber in relation to the longitudinal centerline of the suppressor body.

19. The firearm suppressor of claim 1, wherein the two or more external channels comprise four external channels, each of which is angularly spaced from an adjacent external channel by about 90 degrees.

20. The firearm suppressor of claim 1, wherein the two or more external channels are located entirely radially outward of the outer surface of the suppressor body in relation to the longitudinal centerline of the suppressor body.

21. A firearm comprising:

a firearm suppressor comprising:

a suppressor body having a muzzle attachment portion and an interior horizontal wall;

two or more external channels disposed around an outer surface of the suppressor body, each of the two or more external channels having a hollow center, a proximal end, and a distal end;

a plurality of baffles arranged within the suppressor body; and a primary expansion chamber defined at least in part by a first baffle of the plurality of baffles and a first portion of the interior horizontal wall of the suppressor body, wherein:

each said proximal end of the two or more external channels comprises a gas port that interfaces with the primary expansion chamber;

each said distal end of the two or more external channels comprises an opening configured to permit gas to exit the suppressor body during use;

at least a portion of the two or more external channels is defined in part by the first portion of the interior horizontal wall of the suppressor body;

at least a section of the first portion of the interior horizontal wall is located between the gas port and the first baffle;

an outer periphery of the primary expansion chamber is spaced maximally from a longitudinal centerline of the suppressor body by a first distance;

the two or more external channels are spaced minimally from the longitudinal centerline of the suppressor body by a second distance greater than the first distance; and each of the two or more external channels is unobstructed.

22. The firearm of claim 21, wherein the firearm is a rifle.

23. The firearm of claim 21, wherein the two or more external channels extend in a longitudinal direction of the suppressor body.

24. The firearm of claim 21, wherein the two or more external channels are located entirely radially outward of the outer surface of the suppressor body in relation to the longitudinal centerline of the suppressor body.

25. The firearm of claim 21, wherein the two or more external channels are spaced symmetrically about an outer circumference of the firearm suppressor.

* * * * *